US007195450B2

(12) United States Patent
Takamatsu

(10) Patent No.: US 7,195,450 B2
(45) Date of Patent: Mar. 27, 2007

(54) MULTIBLADE FAN AND ELECTRONIC APPARATUS HAVING A MULTIBLADE FAN

(75) Inventor: Hiroaki Takamatsu, Tokyo (JP)

(73) Assignee: NEC Viewtechnology, Ltd., Tokyo (JP)

( * ) Notice: Subject to any disclaimer, the term of this patent is extended or adjusted under 35 U.S.C. 154(b) by 0 days.

(21) Appl. No.: 10/915,099

(22) Filed: Aug. 10, 2004

(65) Prior Publication Data

US 2005/0095120 A1 May 5, 2005

(30) Foreign Application Priority Data

Aug. 11, 2003 (JP) ..... 2003-291746

(51) Int. Cl.
*F04D 29/66* (2006.01)

(52) U.S. Cl. ..... 415/119; 416/182

(58) Field of Classification Search ..... 415/119, 415/204, 206, 212.1; 416/182
See application file for complete search history.

(56) References Cited

U.S. PATENT DOCUMENTS

| | | | | |
|---|---|---|---|---|
| 2,290,423 | A * | 7/1942 | Funk | 415/151 |
| 4,549,848 | A * | 10/1985 | Wallman | 415/206 |
| 5,551,836 | A * | 9/1996 | Roth et al. | 415/204 |
| 5,570,996 | A * | 11/1996 | Smiley, III | 415/53.2 |
| 6,439,839 | B1 * | 8/2002 | Song et al. | 415/119 |
| 6,884,033 | B2 * | 4/2005 | Liao | 415/206 |
| 2004/0191060 | A1 * | 9/2004 | Chiu et al. | 415/206 |

FOREIGN PATENT DOCUMENTS

| | | | |
|---|---|---|---|
| JP | S55-060497 | | 4/1980 |
| JP | S56-171699 | | 12/1981 |
| JP | 05-274062 | | 10/1993 |
| JP | H07-224795 | | 8/1995 |
| JP | 09-126193 | * | 5/1997 |
| JP | 10-141294 | | 5/1998 |
| JP | 10-197953 | | 7/1998 |
| JP | 11-354963 | | 12/1999 |
| JP | 2000-035614 | | 2/2000 |
| JP | 2001-135964 | | 5/2001 |
| JP | 2001-142147 | | 5/2001 |
| JP | 2002-098096 | | 4/2002 |
| JP | 2002-188597 | | 7/2002 |
| JP | 2002-257091 | | 9/2002 |
| JP | 2004-339997 | | 12/2004 |

* cited by examiner

*Primary Examiner*—Edward K. Look
*Assistant Examiner*—Nathan Wiehe
(74) *Attorney, Agent, or Firm*—Scully, Scott, Murphy & Presser, P.C.

(57) ABSTRACT

A multiblade fan includes a case having an air intake port and an air exhaust port, an impeller disposed in said case and having a plurality of blades rotatable about the center of said air intake port, and a noise silencer fin extending substantially parallel to the opening plane of said air intake port, the noise silencer fin being disposed near the tongue of said case. The noise silencer fin suppresses excessive pressure variations and flow speed fluctuations in the vicinity of the air intake port, thereby suppressing the generation of noise.

12 Claims, 8 Drawing Sheets

MULTIBLADE FAN AND ELECTRONIC APPARATUS HAVING A MULTIBLADE FAN

BACKGROUND OF THE INVENTION

1. Field of the Invention

The present invention relates to a multiblade fan typified by a sirocco fan, and more particularly to a technology for reducing noise generated by a multiblade fan. The present invention also pertains to an electronic apparatus having a low-noise multiblade fan.

2. Description of the Related Art

Various technologies have been developed in recent years for reducing noise generated by home electric appliances. Demands for lower noise are not limited to home electronic appliances, but also apply to electronic devices. In particular, in the field of personal computers, not only personal computers per se, but also peripheral devices such as printers and display units, are required to reduce noise.

Electronic devices have components such as magnetic disk drives, CPUs, power supplies, and light sources which generate heat during operation. These heat-generating parts need to be cooled in order to maintain their performance and reliability. There are generally two types of designs for cooling heat-generating parts, i.e., air cooling designs and liquid cooling designs. The air cooling designs are grouped into the category of natural air cooling systems and the category of forced air cooling systems. According to the forced air cooling systems, a cooling fan forcibly applies air to a heat-generating component or air is forcibly discharged from an electronic device. If a higher cooling effect is to be achieved, then the operating sound of the cooling fan tends to be perceived as noise. Generally, electric devices having larger heat-generating parts are liable to generate larger sounds from cooling fans.

One electronic device that has larger heat-generating parts is a projector. In terms of cooling mechanisms, conventional projectors are classified into projectors of the type which cool heat-generating parts with an axial fan and projectors of the type which cool heat-generating parts with a multiblade fan (sirocco fan). A projector of the former type has an air intake fan for introducing external air and delivering the introduced air through an air filter to a liquid crystal display unit, and an air exhaust fan for discharging hot air in the projector out of the projector. Some projectors also have an auxiliary fan in addition to the air intake fan and the air exhaust fan.

A projector of the latter type has a multiblade fan (sirocco fan) and a cooling duct. Air around a heat-generating component is drawn through the cooling duct into the multiblade fan, and discharged out of the projector through a exhaust port disposed in the front portion of the projector (see Japanese laid-open patent publication No. 11-354963).

As described above, a projector cooling mechanism employs an axial fan or a multiblade fan. In general, multiblade fans typified by a sirocco fan are widely used to cool devices having large internal resistance because the multiblade fans are capable of developing higher static pressure than the axial fans.

Attempts have been made to reduce noise produced by the cooling mechanism for projectors. For example, Japanese laid-open patent publication No. 10-197953 discloses a technique to reduce noise with a grid member having a plurality of rectangular or circular openings which is disposed in an upstream position in an air passage that is located near to an air exhaust fan. Japanese laid-open patent publication No. 2000-35614 reveals another arrangement for reducing noise with a net-like flow rectifier which is disposed at the downstream end of a heat sink with respect to the air flow through the heat sink. Japanese laid-open patent publication No. 2001-142147 shows still another scheme for lowering noise with a sound silencer box having an air passage chamber through which air discharged from a cooling mechanism passes.

Efforts have also been made to reduce noise produced by the cooling multiblade fan itself. For example, Japanese laid-open patent publication No, 10-141294 discloses a technique for reducing noise with a barrier wall which is disposed within the blades of impeller and which suppress the vortex flow. Multiblade fans typified by a sirocco fan produce more noise, called nz-noise, at frequencies offensive to the ear than axial fans because the pressure of air varies when the blades of the impeller pass in the vicinity of the tongue of the fan case, generating nz-noise whose frequency is based on the frequency of the air pressure variations. The frequency f (Hz) of nz-noise produced by a sirocco fan is expressed by $f=n\times z/60$ where n represents the rotational speed (rpm) of the sirocco fan and z the number of blades of the impeller. When a general small-type sirocco fan having 30 blades rotates at a rotational speed of 5000 rpm, the frequency of produced nz-noise is expressed as $f=5000\times 30/60=2500$ (Hz). Since this nz-noise frequency falls into a frequency range from 1 kHz to 4 kHz that is most offensive to the ear, the nz-noise is perceived as annoying noise even if its level is low.

It has been proposed to provide multiblade fans with a fin for suppressing the above offensive noise. However, it is difficult to incorporate the proposed fin into small-size multiblade fans since it would be necessary to increase the number of blades or to increase the rotational speed of the fan in order to shift the frequency of nz-noise into a less offensive frequency range while at the same time causing the fan to produce high static pressure. Stated otherwise, technical difficulties will be encountered in producing dies capable of forming small-size multiblade fans having more blades than up to the present. In addition, an increase in the rotational speed will cause a reduction in the durability of fans.

SUMMARY OF THE INVENTION

It is an object of the present invention to provide a multiblade fan that has a fin for reducing noise that is offensive to the ear.

Another object of the present invention is to provide an electronic apparatus which incorporates a multiblade fan having a fin for reducing noise that is offensive to the ear.

According to the present invention, a plate-like noise silencer fin is mounted on a case which houses therein an impeller having a plurality of blades rotatable about the center of an air intake port. The noise silencer fin is disposed near a tongue of the case and extends substantially parallel to the opening plane of the air intake port.

Desirably, the noise silencer fin has a rectangular planar shape, and is disposed in a position that is inward of the opening plane of the air intake port with respect to the direction in which air flows into the air intake port. The noise silencer fin may be movable along the edge of the air intake port. The multiblade fan according to the present invention is suitable for use as a fan for cooling an electronic apparatus.

The above and other objects, features, and advantages of the present invention will become apparent from the following description with reference to the accompanying drawings which illustrate examples of the present invention.

DESCRIPTION OF THE PREFERRED EMBODIMENTS (First Embodiment of the Invention)

Figure 1:
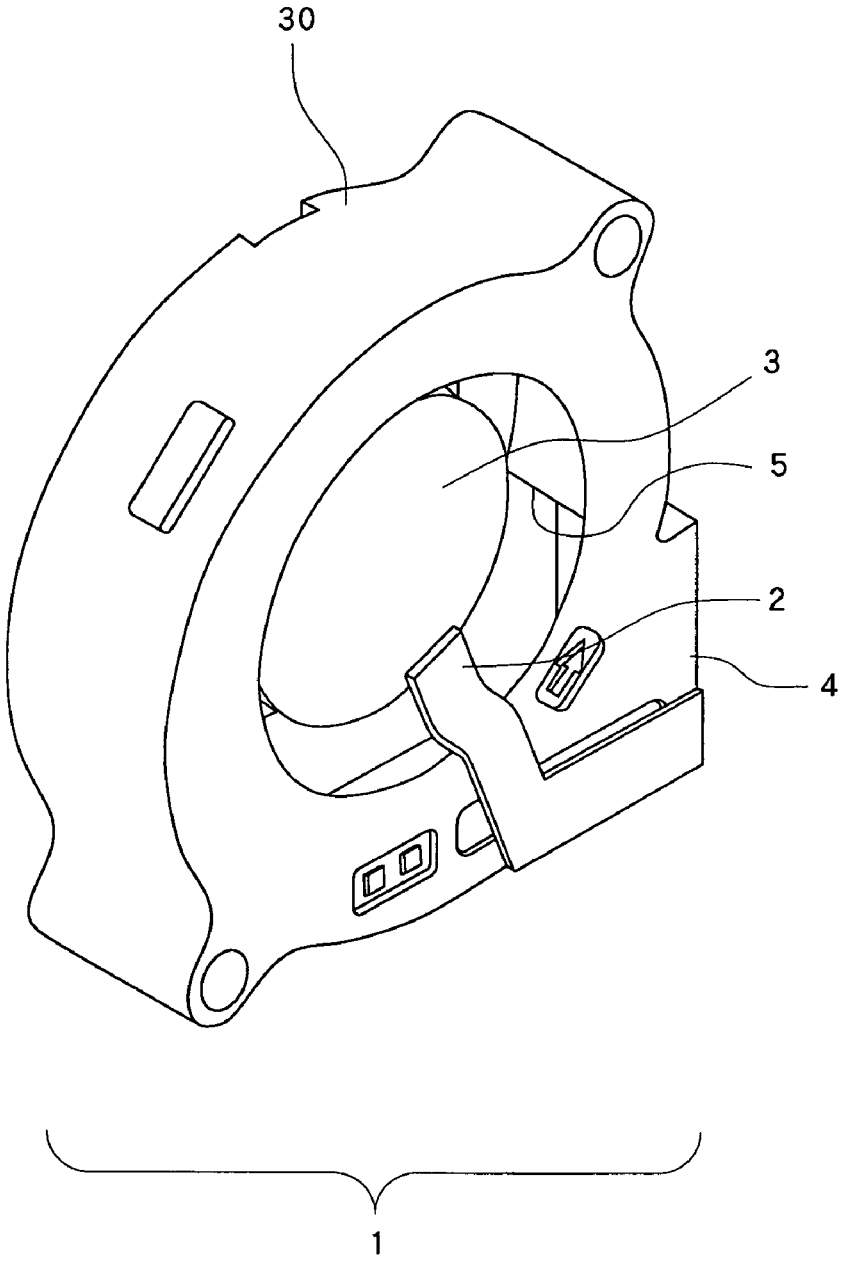
FIG. 1 is a perspective view of a multiblade fan according to the first embodiment of the present invention.
Figure 2:
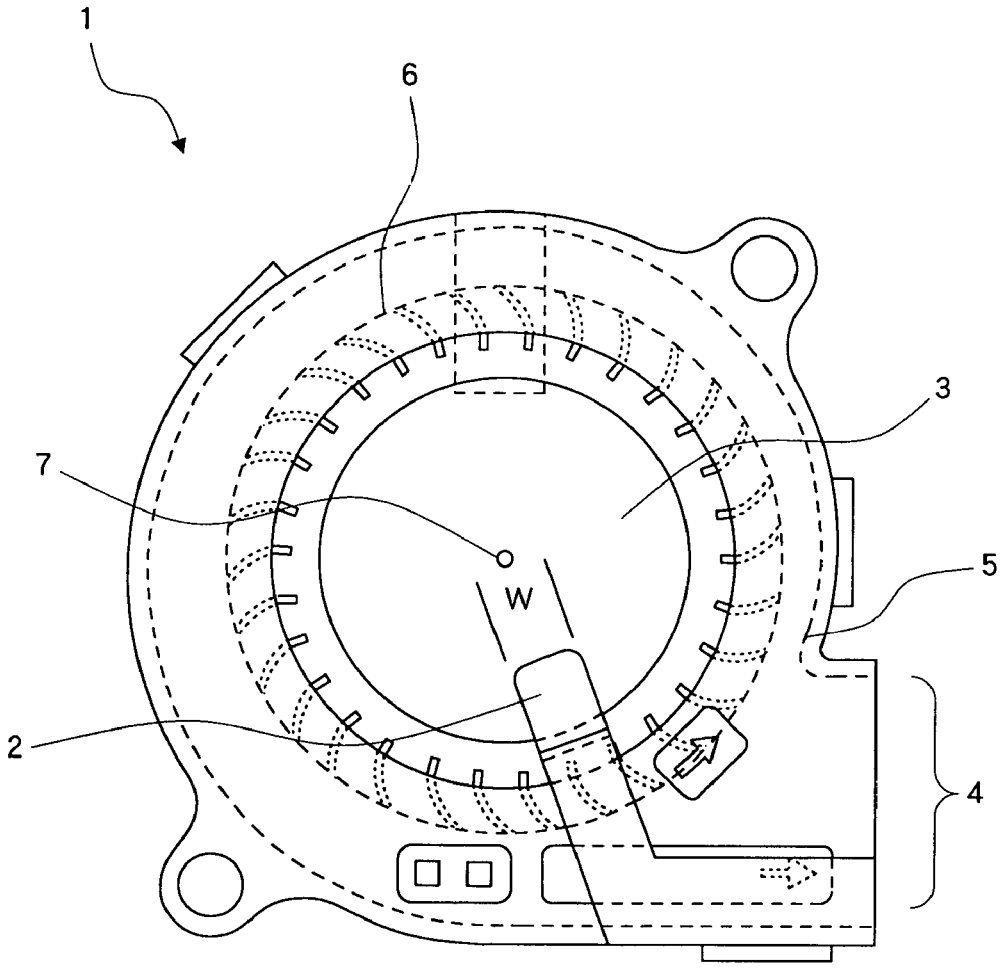
FIG. 2 is a plan view of the multiblade fan according to the first embodiment of the present invention.
Figure 3:
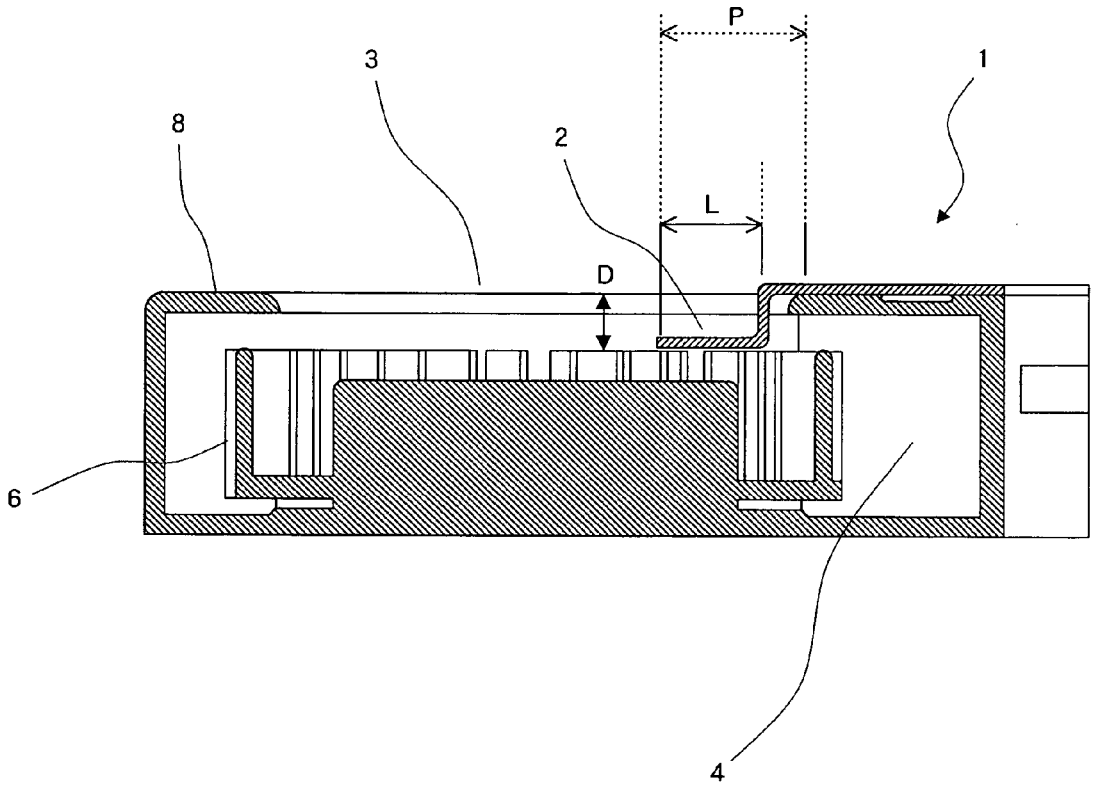
FIG. 3 is a cross-sectional view of the multiblade fan according to the first embodiment of the present invention.

FIG. 1 is a perspective view of a multiblade fan according to the first embodiment of the present invention, FIG. 2 is a plan view of the multiblade fan, and FIG. 3 is a cross-sectional view of the multiblade fan.

Multiblade fan 1 has impeller 6 rotatable at a high speed in case 30 for drawing ambient air from air intake port 3 defined in the front panel of case 30 and for discharging air from air exhaust port 4 defined in the side panel of case 30.

For reducing noise produced by multiblade fan 1 of the above structure, it is important that a plate-like structural body having a finite area and extending substantially parallel to the opening plane of air intake port 3 be disposed within impeller 6 and near tongue 5 of case 30. According to the present embodiment, multiblade fan 1 has plate-like noise silencer fin 2 attached to the front face of case 30 and the noise silencer fin 2 has a distal end portion projecting radially inwards of the peripheral edge of air intake port 3 in the vicinity of tongue 5. The distal end portion of noise silencer fin 2 which projects into air intake port 3 is bent into a step and disposed between the end of impeller 6 near air intake port 3 and the opening plane of air intake port 3. The distal end portion of noise silencer fin 2 is held in the above position substantially parallel to the opening plane of air intake port 3.

Noise silencer fin 2, thus constructed and disposed, suppresses excessive pressure variations and flow speed fluctuations in the vicinity of air intake port 3. As a result, noise generated by multiblade fan 1 is reduced, or the distribution of frequencies of sounds produced by multiblade fan 1 is changed, or the level of sound having certain frequency components is suppressed, thus lowering the level of noise and lowering nz-noise that is perceived as offensive to the human ear.

Structural details of multiblade fan 1 shown in FIGS. 1 through 3 will be described below. Multiblade fan 1 has outer dimensions of 51 mm (vertical)×51 mm (horizontal)×15 mm (height). Impeller 6 has a rotational speed of 5500 rpm, displaces a maximum air volume of 0.10 $m^3$/min., and produces a maximum static pressure of 200 Pa. Impeller 6 is constructed of a total of 30 blades that are spaced at an interval of about 3.3 mm. Air intake port 3 has a diameter of 32 mm, and air exhaust port 4 has a width of 20 mm and a height of 15 mm.

Noise silencer fin 2 is in the form of an aluminum alloy plate having a thickness of 0.5 mm. The distal end portion of noise silencer fin 2 which is bent into a step and extends into air intake port 3 has a rectangular shape. The distal end portion of noise silencer fin 2 has a width W of 5.0 mm and a length L of 6.0 mm, and its tip end is located at a distance P of 8.4 mm from the peripheral edge of air intake. The material of noise silencer fin 2 is not limited to an aluminum alloy, but may be another metal such as stainless steel, brass, or the like. Noise silencer fin 2 may be fixed to the front face of case 30 by an adhesive. However, the medium by which noise silencer fin 2 is secured in place is not limited to an adhesive. Noise silencer fin 2 may be fixed to case 30 by a double-sided tape. Any medium may be used to fix noise silencer fin 2 in place insofar as it maintains reliability and safety.

Noise generated by multiblade fan 1 had a level of 40 dB. When noise silencer fin 2 was removed from multiblade fan 1, noise generated by multiblade fan 1 had a level of 42 dB. Therefore, noise silencer fin 2 lowers (improves) the noise level by about 2.0 dB. Noise generated by multiblade fan 1 with noise silencer fin 2 having a thickness of 0.3 mm also had a level of about 40 dB. Consequently, unless the shape of noise silencer fin 2 is unduly changed due to air pressure, the noise suppressing capability thereof does not change even if the thickness of noise silencer fin 2 is smaller than 0.3 mm. The noise suppressing capability remained unchanged when the thickness of noise silencer fin 2 changed to 2.0 mm, and it was confirmed when the width W of noise silencer fin 2 was 3.0 mm. However, depending upon the position of noise silencer fin 2, the effect of the noise suppressing capability was strictly limited. For obtaining a sufficient noise suppressing capability, therefore, it is necessary for a flat plate having a certain size to be present within air intake port 3.

If the width W of noise silencer fin 2 is too large, then the air discharging efficiency is lowered because noise silencer fin 2 covers a wide area in air intake port 3. Consequently, the appropriate width W of noise silencer fin 2 according to the present embodiment is about 5.0 mm. This width W corresponds to slightly less than twice the interval between adjacent blades. The distance D from the front face 8 of case 30 (the opening plane of air intake port 3) to the bottom of noise silencer fin 2 is 3.5 mm. No change was observed in the noise suppressing capability if the distance D was in the range of 3.0 mm to 4.0 mm. If the distance D is longer than 4.0 mm, then the possibility of interference between impeller 6 and noise silencer fin 2 is high. If the distance D is shorter than 3.0 mm, then the noise suppressing capability is small.

The noise suppressing capability often increases if the distal end portion of noise silencer fin 2 is of a rectangular shape. Though a certain level of the noise suppressing capability was confirmed even if the distal end portion of noise silencer fin 2 was of a triangular or circular shape, the noise suppressing capability was smaller than if the distal end portion was of a rectangular shape. The position where noise silencer fin 2 is located is also of importance. The noise suppressing capability is maximum when the side of the distal end portion of noise silencer fin 2 lies perpendicularl to the central line extending outwardly from impeller shaft 7. The noise level dropped about 2.0 dB even if noise silencer fin 2 extended from the inner, rather than from the outer side of air intake port 3. That is, the same noise suppressing capability is achieved if the distal end portion of noise silencer fin 2 is in the same position. For example, even if noise silencer fin 2 is not mounted on case 30, but is in an electronic apparatus where multiblade fan 1 is installed, the same noise suppressing capability as described above is achieved if the distal end portion of noise silencer fin 2 is in the same position as described above.

(Second Embodiment of the Invention)

The multiblade fan according to the present invention is suitable for use as a fan for cooling an electronic apparatus. Environments for multiblade fans installed in electronic apparatus are diverse and cannot be specified. Noise generated by multiblade fans depends on various states (flow speeds, pressure variations, flow speed fluctuations, paths, etc.) of air flowing into the air intake port, the structure of the impeller, and how air flows into the air exhaust port. The nz-noise depends on the structure of the impeller, particularly, the number of blades. Conventional arrangements with respect to the reduction of noise of multiblade fans, e.g., the technology disclosed in Japanese laid-open patent publication No. 2002-257091, achieve the desired effect before the multiblade fan is installed in an electronic apparatus, but may not accomplish the desired effect after the multiblade fan is installed in an electronic apparatus because they assume that there is nothing around the multiblade fan.

However, there are various objects existing around a multiblade fan installed in an electronic apparatus, and it can easily be imagined that the air flow path into the air intake port of the multiblade fan and the pressure variations depend on the manner in which the multiblade fan is installed. If there is sufficient space around a multiblade fan installed in an electronic apparatus, then such a state is analogous to a state wherein the multiblade fan exists alone. Therefore, the noise suppressing capability is substantially the same before and after the multiblade fan is installed. Conversely, if a multiblade fan is incorporated in an electronic apparatus having many components mounted in close proximity to each other, then various components exist around the multiblade fan. If some components are present in the vicinity of the air intake port of the multiblade fan, then the same noise suppressing capability as that achieved prior to the installation of the multiblade fan may not be obtained. This is believed to happen because the air flow path and the pressure distribution near the air intake port change greatly before and after the multiblade fan is installed.

The noise silencer fin of the multiblade fan according to the present embodiment is movable along an edge of the air intake port. The noise silencer fin that has been moved to an optimum position depending on the manner in which the electronic apparatus is installed suppresses excessive pressure variations and flow speed fluctuations in the vicinity of the air intake port. As a result, even if the air flow path and the pressure distribution near the air intake port change before and after the multiblade fan is installed, the generation of noise is suppressed by the noise silencer fin that has been moved to a position for reducing noise to the lowest level or to a position for minimizing noise offensive to the ear.

As described above, inasmuch as the multiblade fan according to the present embodiment accomplishes the desired effect regardless of the manner in which it is installed in an electronic apparatus, the multiblade fan can be incorporated into various electronic apparatus. This means that the multiblade apparatus is highly versatile, low in cost, and highly valuable for industrial application.

Figure 4:
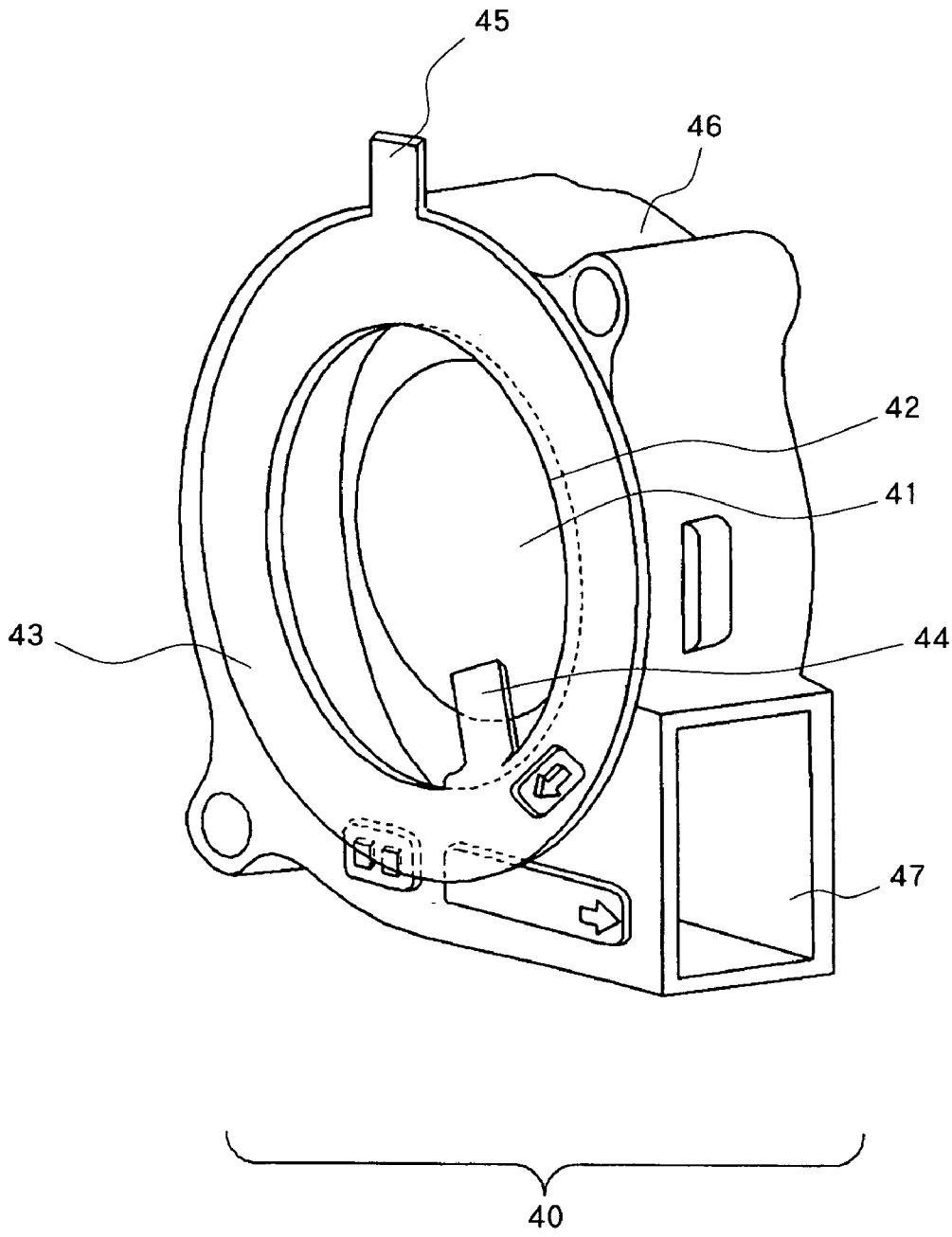
FIG. 4 is a perspective view of a multiblade fan according to the second embodiment of the present invention.
Figure 5:
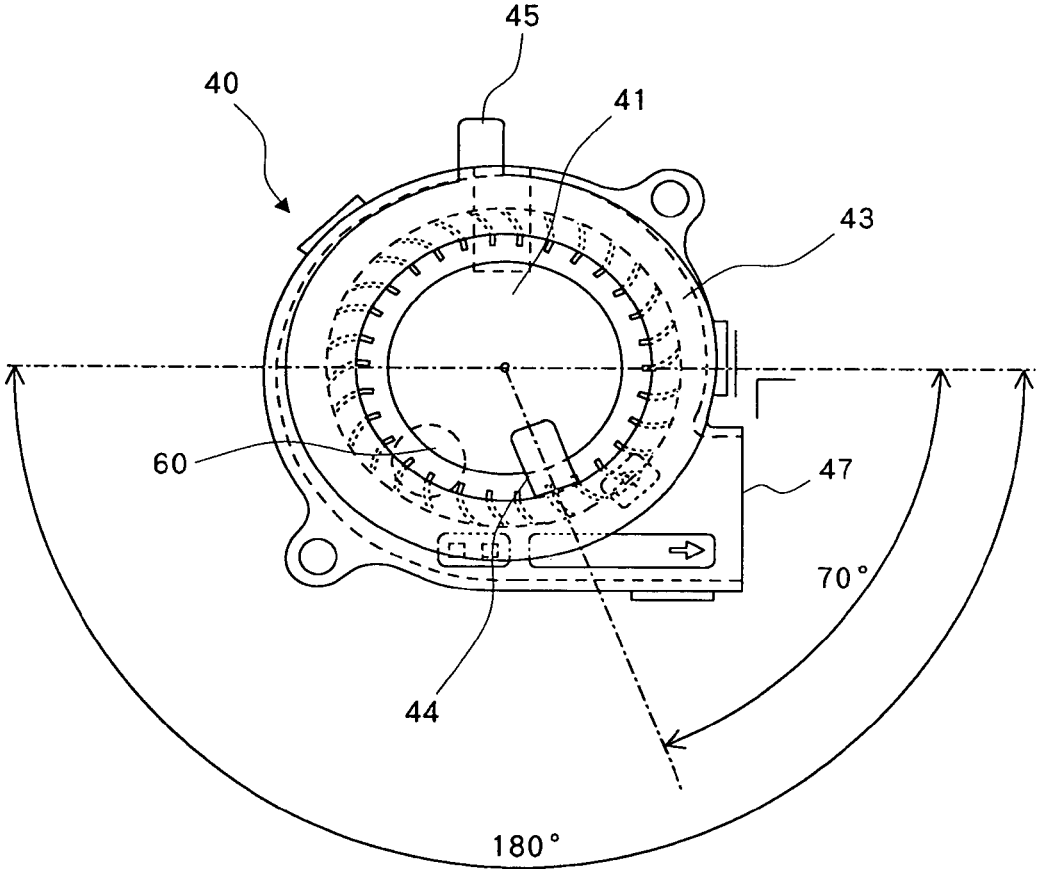
FIG. 5 is a plan view of the multiblade fan according to the second embodiment of the present invention.
Figure 6:
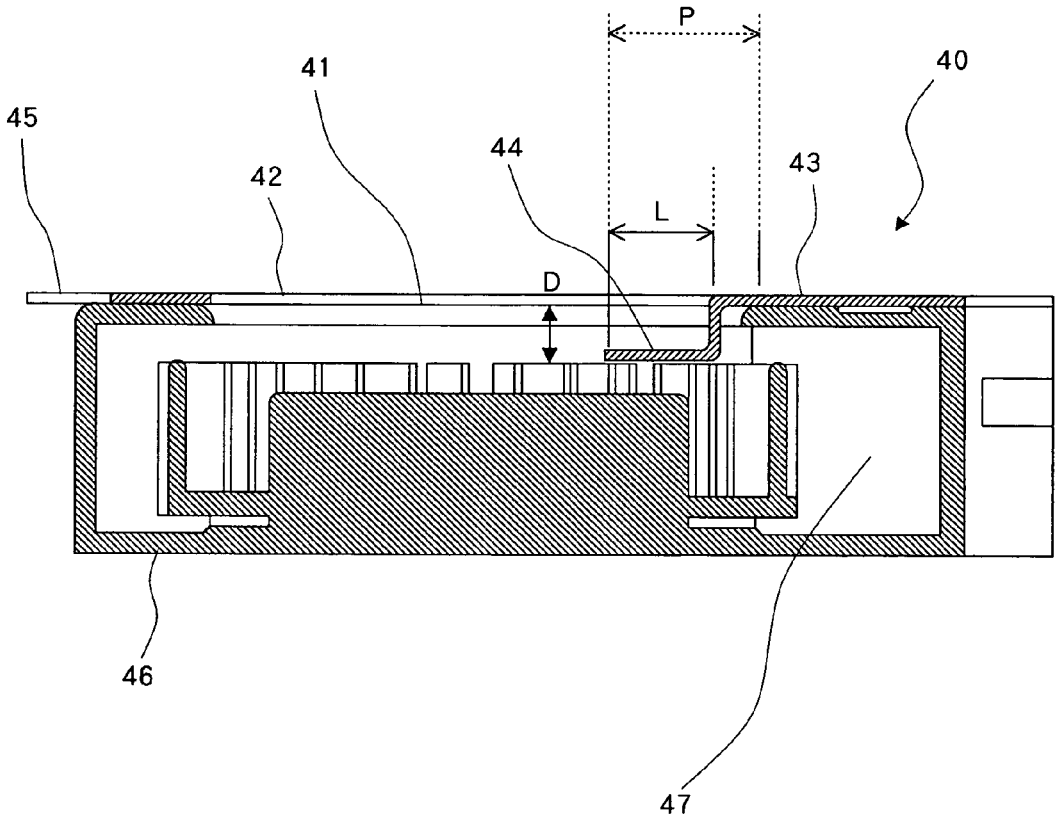
FIG. 6 is a cross-sectional view of the multiblade fan according to the second embodiment of the present invention.

The structure of the multiblade fan according to the present embodiment will be described in specific detail below. FIG. 4 is a perspective view of multiblade fan 40 according to the present embodiment. FIG. 5 is a plan view of the multiblade fan, and FIG. 6 is a cross-sectional view of the multiblade fan.

Multiblade fan 40 according to the present embodiment has annular rotary plate 43 having hole 42 held in communication with air intake port 41. Noise silencer fin 44 is mounted on a radially inner edge of rotary plate 43. Adjusting knob 45 is mounted on a radially outer edge of rotary plate 43. Rotary plate 43 is rotatably mounted on the front face of case 46 having air intake port 41 defined therein. When adjusting knob 45 is operated, rotary plate 43 rotates along the edge of air intake port 41 about an impeller shaft (not shown). When rotary plate 43 is rotated, noise silencer fin 44 mounted on rotary plate 43 moves in an angular range of 180 degrees shown in FIG. 5. A reference line of the angular range of 180 degrees extends through the center of air intake port 41 and is perpendicularl to the opening plane of air exhaust port 47. An angular range of 70 degrees shown in FIG. 5 represents the position of noise silencer fin 44 where sufficient noise suppressing capability is achieved when multiblade fan 40 is not installed in an electronic apparatus.

Other structural details than described above are identical to those which have been described above with respect to the first embodiment. The distance P from the edge of air intake port 41 to the tip end of the distal end portion of noise silencer fin 44, the distance D from front face 48 of the case (the opening plane of air intake port 41) to the bottom of noise silencer fin 44, and the length L of the distal end portion of noise silencer fin 44 are identical to the distances and length described above with respect to the first embodiment.

Figure 7:
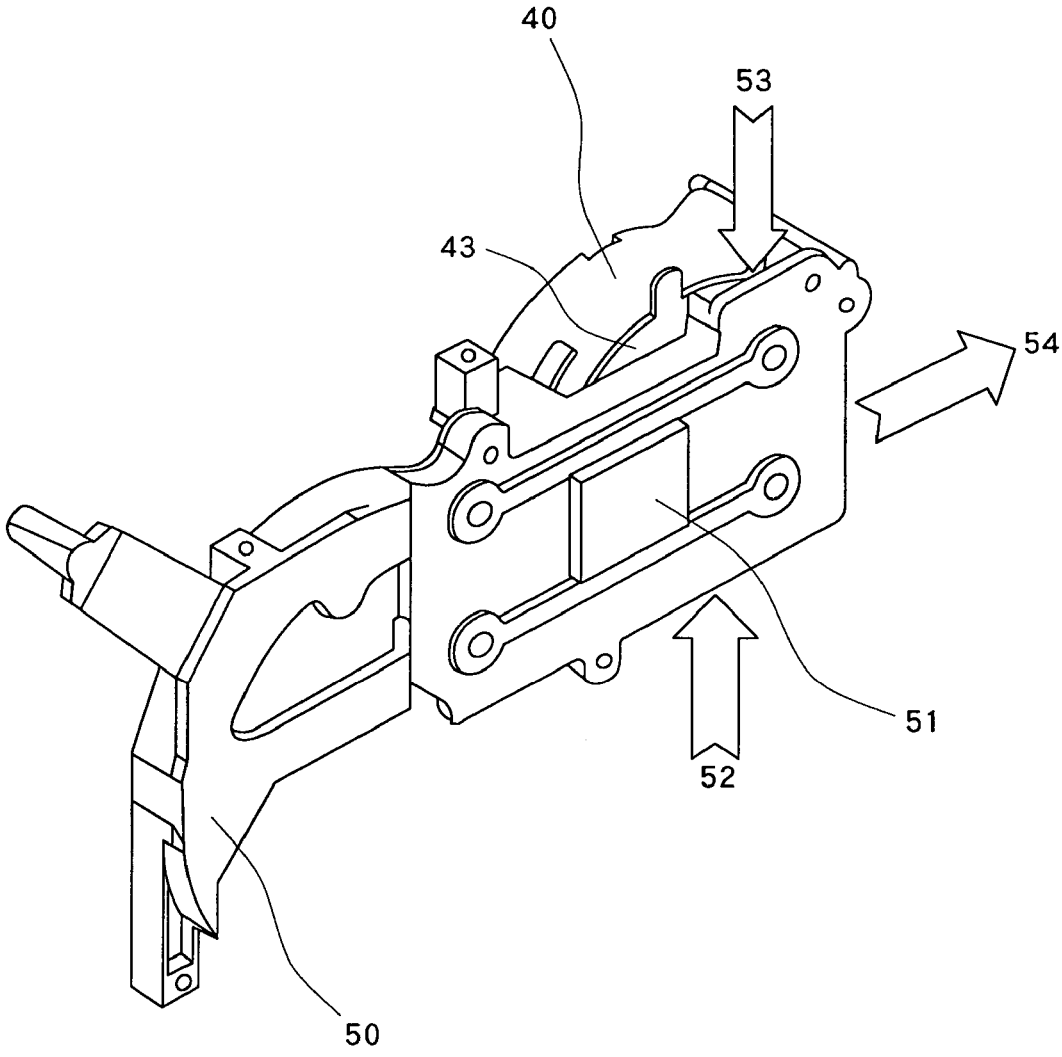
FIG. 7 is a perspective view of an electronic apparatus incorporating a multiblade fan according to the present invention.
Figure 8:
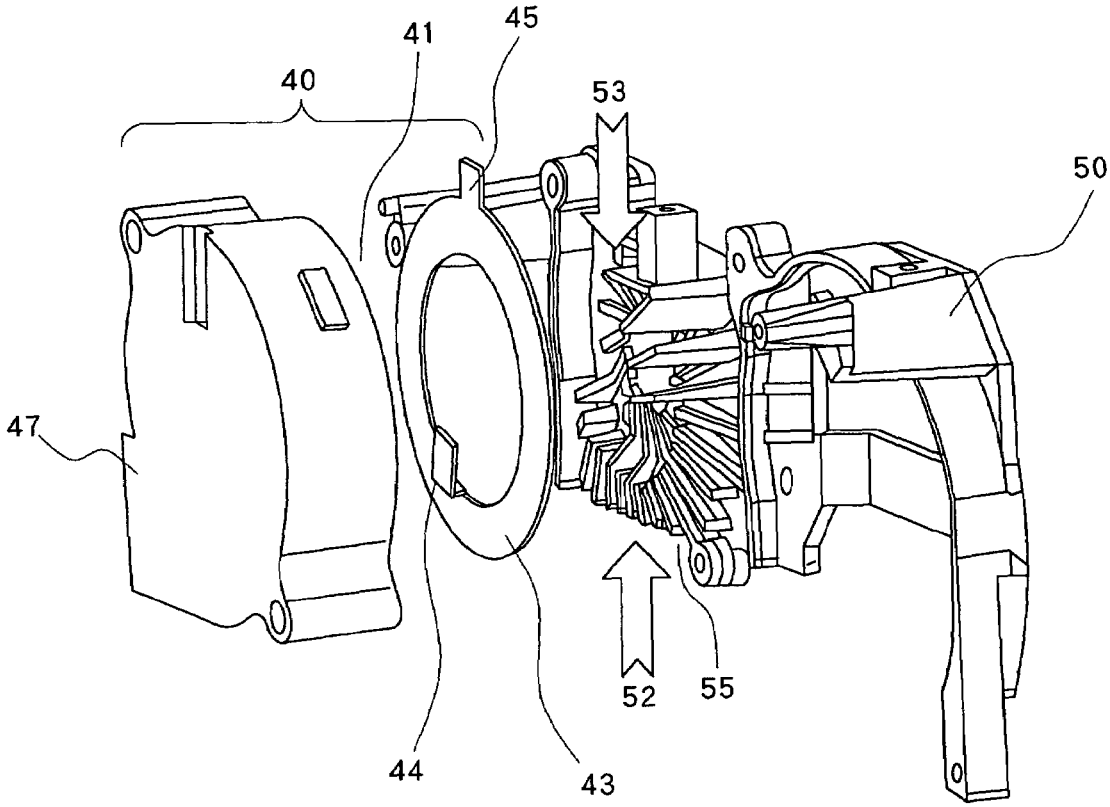
FIG. 8 is an exploded perspective view of the electronic apparatus incorporating the multiblade fan according to the present invention.

FIG. 7 is a perspective view showing, by way of example, an installed state of multiblade fan 40 according to the present embodiment, and FIG. 8 is an exploded perspective view showing the installed state thereof. In FIGS. 7 and 8, the multiblade fan is installed in a projection-type display unit. The projection-type display unit is an electronic apparatus for projecting an image, which is similar to an image formed by an image display device, onto a screen with intensive light. The projection-type display unit needs to have a cooling mechanism because the temperature of components that is irradiated with the intensive light is considerably high. Moreover, the projection-type display unit needs to have a cooling mechanism that can be incorporated into an apparatus constructed of many components mounted in close proximity to each other and can discharge a large volume of air with low noise.

Heat sink 50 is disposed outside of air intake port 41 of multiblade fan 40 shown in FIGS. 7 and 8. Heat sink 50 has image display device contact member 51 on its surface which is held in close contact with an image display device (not shown). The heat of the image display device is diffused through image display device contact member 51 into heat sink 50 in its entirety. In FIGS. 7 and 8, the arrows 52, 53 indicate paths along which air flows into multiblade fan 40, and the arrow 54 indicates a path along which air is discharged from multiblade fan 40. Heat sink 50 has heat radiating fins 55 mounted on an inner wall thereof. Heat radiating fins 55 increase the surface area of heat sink 50 for an increased heat radiating capability. Air which is introduced from outside deprives heat sink 50 of the heat when it passes through heat radiating fins 55. Then, the air is introduced from air intake port 3 of multiblade fan 40 into multiblade fan 40, and is then discharged from air discharge port 47.

As described above, heat sink 50 is disposed in the vicinity of air intake port 41 of multiblade fan 40 which has been installed, and heat radiating fins 55 are present between air intake port 41 and heat sink 50. Therefore, the resistance to the flow of air and the pressure in the vicinity of air intake port 41 differ before and after multiblade fan 40 is installed. Rotary plate 43 has been rotated to move noise silencer fin 44 to an optimum position which reduces noise to the lowest level. The optimum position reached at this time is indicated by 60 in FIG. 5, and falls in the angular range of 180 degrees shown in FIG. 5.

The level of noise generated by multiblade fan 40 with noise silencer fin 44 disposed in the optimum position was about 1.5 dB lower than the level of noise generated by a multiblade fan which does not have noise silencer fin 44. In particular, the peak value of noise that is offensive to the ear in the frequency range from 1 kHz to 4 kHz was reduced by 10 dB at a maximum. It is important to reduce noise that is actually offensive to the ear, rather than to only improve the general noise level.

Insofar as noise silencer fin 44 is disposed in the above position, the same noise suppressing capability as described above can be achieved even if rotary plate 43 is mounted on heat sink 50.

While preferred embodiments of the present invention have been described using specific terms, such description is for illustrative purposes only, and it is to be understood that changes and variations may be made without departing from the spirit or scope of the following claims.

What is claimed is:

1. A multiblade fan comprising:

a case having an air intake port and an air exhaust port;

an impeller disposed in said case and having a plurality of blades rotatable about a center of said air intake port; and a noise silencer fin extending substantially parallel to an opening plane of said air intake port, said noise silencer fin having a width dimensioned as less than twice the interval between adjacent blades of said plurality of blades;

said noise silencer fin being disposed near the tongue of said case.

2. A multiblade fan according to claim 1, wherein said multiblade fan is a cooling fan in an electronic apparatus.

3. A multiblade fan comprising:

a case having an air intake port and an air exhaust port;

an impeller disposed in said case and having a plurality of blades rotatable about the center of said air intake port; and a noise silencer fin extending substantially parallel to an opening plane of said air intake port, said noise silencer fin having a width dimensioned as less than twice the interval between adjacent blades of said plurality of blades;

said noise silencer fin being disposed near the tongue of said case and inwardly of the opening plane of said air intake port with respect to a direction in which air flows into said air intake port.

4. A multiblade fan according to claim 3, wherein said multiblade fan is a cooling fan in an electronic apparatus.

5. A multiblade fan comprising:

a case having an air intake port and an air exhaust port;

an impeller disposed in said case and having a plurality of blades rotatable about the center of said air intake port; and a noise silencer fin extending substantially parallel to the opening plane of said air intake port, said noise silencer fin having a width dimensioned as less than twice the interval between adjacent blades of said plurality of blades;

said noise silencer fin being movable along the edge of said air intake port.

6. A multiblade fan according to claim 5, wherein said multiblade fan is a cooling fan in an electronic apparatus.

7. A multiblade fan comprising:

a case having an air intake port and an air exhaust port;

an impeller disposed in said case and having a plurality of blades rotatable about a center of said air intake port; and a noise silencer fin extending substantially parallel to the opening plane of said air intake port and having a rectangular planar shape, said noise silencer fin having a width dimensioned as less than twice the interval between adjacent blades of said plurality of blades;

said noise silencer fin being disposed near the tongue of said case.

8. A multiblade fan according to claim 7, wherein said multiblade fan is a cooling fan in an electronic apparatus.

9. A multiblade fan comprising:

a case having an air intake port and an air exhaust port;

an impeller disposed in said case and having a plurality of blades rotatable about the center of said air intake port; and a noise silencer fin extending substantially parallel to the opening plane of said air intake port and having a rectangular planar shape, said noise silencer fin having a width dimensioned as less than twice the interval between adjacent blades of said plurality of blades;

said noise silencer fin being disposed near the tongue of said case and inwardly of the opening plane of said air intake port with respect to the direction in which air flows into said air intake port.

10. A multiblade fan according to claim 9, wherein said multiblade fan is a cooling fan in an electronic apparatus.

11. A multiblade fan comprising:

a case having an air intake port and an air exhaust port;

an impeller disposed in said case and having a plurality of blades rotatable about the center of said air intake port; and a noise silencer fin extending substantially parallel to an opening plane of said air intake port and having a rectangular planar shape, said noise silencer fin having a width dimensioned as less than twice the interval between adjacent blades of said plurality of blades; said noise silencer fin being movable along an edge of said air intake port.

12. A multiblade fan according to claim 11, wherein said multiblade fan is a cooling fan in an electronic apparatus.

* * * * *